US005483891A

United States Patent [19]

Reichel

[11] Patent Number: 5,483,891

[45] Date of Patent: Jan. 16, 1996

[54] ARRANGEMENT FOR FASTENING A FLEXIBLE PRINTING PLATE

[75] Inventor: Klaus T. Reichel, Augsburg, Germany

[73] Assignee: MAN Roland Druckmaschinen AG, Offenbach Am Main, Germany

[21] Appl. No.: 317,335

[22] Filed: Oct. 4, 1994

[30] Foreign Application Priority Data

Oct. 15, 1993 [DE] Germany ..... 43 35 140.9

[51] Int. Cl.[6] ..... B41F 1/28

[52] U.S. Cl. ..... 101/415.1; 101/382.1

[58] Field of Search ..... 101/415.1, 382.1, 101/383, 387, 378

[56] References Cited

U.S. PATENT DOCUMENTS

| | | | |
|---|---|---|---|
| 3,608,487 | 9/1971 | Luehrs | 101/415.1 |
| 3,626,848 | 12/1971 | Tafel | 101/415.1 |
| 3,757,691 | 9/1973 | Etchell et al. | 101/415.1 |
| 4,214,530 | 7/1980 | Signorelli et al. | 101/415.1 |
| 5,107,763 | 4/1992 | Gevis | 101/382.1 |
| 5,357,863 | 10/1994 | McLean et al. | 101/415.1 |
| 5,363,764 | 11/1994 | Horiguchi et al. | 101/415.1 |

FOREIGN PATENT DOCUMENTS

| | | |
|---|---|---|
| 0534579 | 3/1993 | European Pat. Off. . |
| 2744371 | 4/1979 | Germany . |
| 146161 | 1/1981 | Germany . |

*Primary Examiner*—Edgar S. Burr
*Assistant Examiner*—Anthony H. Nguyen
*Attorney, Agent, or Firm*—Cohen, Pontani, Lieberman & Pavane

[57] ABSTRACT

An arrangement for fastening a flexible printing plate on a form cylinder of a printing press. The form cylinder having at least one axially directed cavity with a first wall that terminates at an acute angle with an outer surface of the cylinder so as to form an edge on which a leading leg of the printing plate is supportable, and a second wall on which a trailing leg of the printing plate is contactable. A spindle is mounted in the cylinder cavity so as to be swivelable about a longitudinal axis. Additionally, a plurality of first and second plate-like springs are distributed along and fastened to the spindle so that the first springs press the leading plate leg against the first wall of the cavity and the second springs press the trailing plate leg against the second wall of the cavity, and so that swiveling of the spindle disengages the springs from the plate legs.

8 Claims, 6 Drawing Sheets

ARRANGEMENT FOR FASTENING A FLEXIBLE PRINTING PLATE

BACKGROUND OF THE INVENTION

1. Field of the Invention

The invention is directed to an arrangement for fastening a flexible printing plate on a form cylinder of a printing press, which form cylinder has at least one axially extending cylinder cavity that supports a leading leg of the printing plate at an edge formed by a first wall of the cavity which terminates at all acute angle with the outer surface of the cylinder. The trailing leg of the printing plate contracts a second, approximately radial wall of the cavity. A plurality of plate-like springs are provided along the length of the printing plate to press the leading and trailing plate legs against the appropriate cavity wall.

2. Discussion of the Prior Art

In EP Application 93 11 233 1.9, the clamping of plates is effected in that the legs of the printing plate are inserted in slots in the form cylinder. A plurality of plate-like springs are located in the slots to secure the plate legs by pressing the latter against the walls of the slot. However, the springs impede removal of the plate, particularly an automated removal.

In DE-AS 27 44 371, plate legs which are inserted into the cylinder cavity are pressed and secured against cavity walls by springs. The springs can be pulled away from the plate legs in order to remove the plate. For this purpose, knobs are displaced using costly mechanisms and a key must be inserted into the clamping groove to actuate the mechanisms. Aside from the extra expenditure involved in design and operation, the device also requires a wide clamping groove.

In EP 0 534 579 A2, a swivelable spindle is located in the cylinder cavity of a plate cylinder. The spindle has a plurality of U-shaped leaf springs which are distributed along the length of the spindle in a groove. In cooperation with a wall of the cavity, one side of each leaf spring clamps the forward or leading leg of the plate. The rear or trailing leg of the plate is secured in the other side of the leaf spring which is beveled. For this reason, the trailing plate leg itself must also be provided with an additional right-angled bevel. This additional beveling adds to the cost of the plate bending machine and also requires a wider clamping groove. Furthermore, the materials from which the printing plate is made have low mechanical strength so that there is a risk that the clamping forces of the printing plate will bend the right-angled bevel of the printing plate and cause the printing plate to detach. Finally, the clamping device works with three operating positions of the spindle. Two different positions of the plate cylinder, necessitating suitable control and position-reporting devices, are required to realize these positions.

SUMMARY OF THE INVENTION

Accordingly, it is an object of the present invention is to provide a printing plate clamping arrangement in which the springs release the legs of the plate by means of simply designed elements to allow removal of the printing plate while ensuring a narrow clamping groove.

Pursuant to this object and others which will become apparent hereafter, one aspect of the present invention resides in a spindle arranged in the cylinder cavity so as to be swivelable about its axis. First and second springs are fastened to the spindle so that the springs can be disengaged from the plate when the spindle is swiveled. The springs reliably clamp the printing plate and the plate legs are released by swiveling the spindle, whereupon the printing plate can be removed, also automatically. Installation of the plate, actuation of the spindle and accordingly the entire plate-changing process can be automated. Only one position of the plate cylinder is required for swiveling the spindle and this position is not subject to exacting requirements with respect to positional accuracy. Accordingly, technical expenditure is economically low. Additionally, the second springs assist in the removal of the trailing plate leg when the spindle is rotated back. The sliding movement of the second springs on the cavity wall accompanying the swiveling of the spindle performs a self-cleaning function which prevents the arrangement from becoming soiled. Finally, the arrangement requires only a narrow clamping groove and has a simple construction so that it can be produced economically. The plate bending mechanism also has a very simple design.

In another embodiment of the invention, a spring-loaded lever is connected to the spindle and contacts a stop to limit swiveling of the lever.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
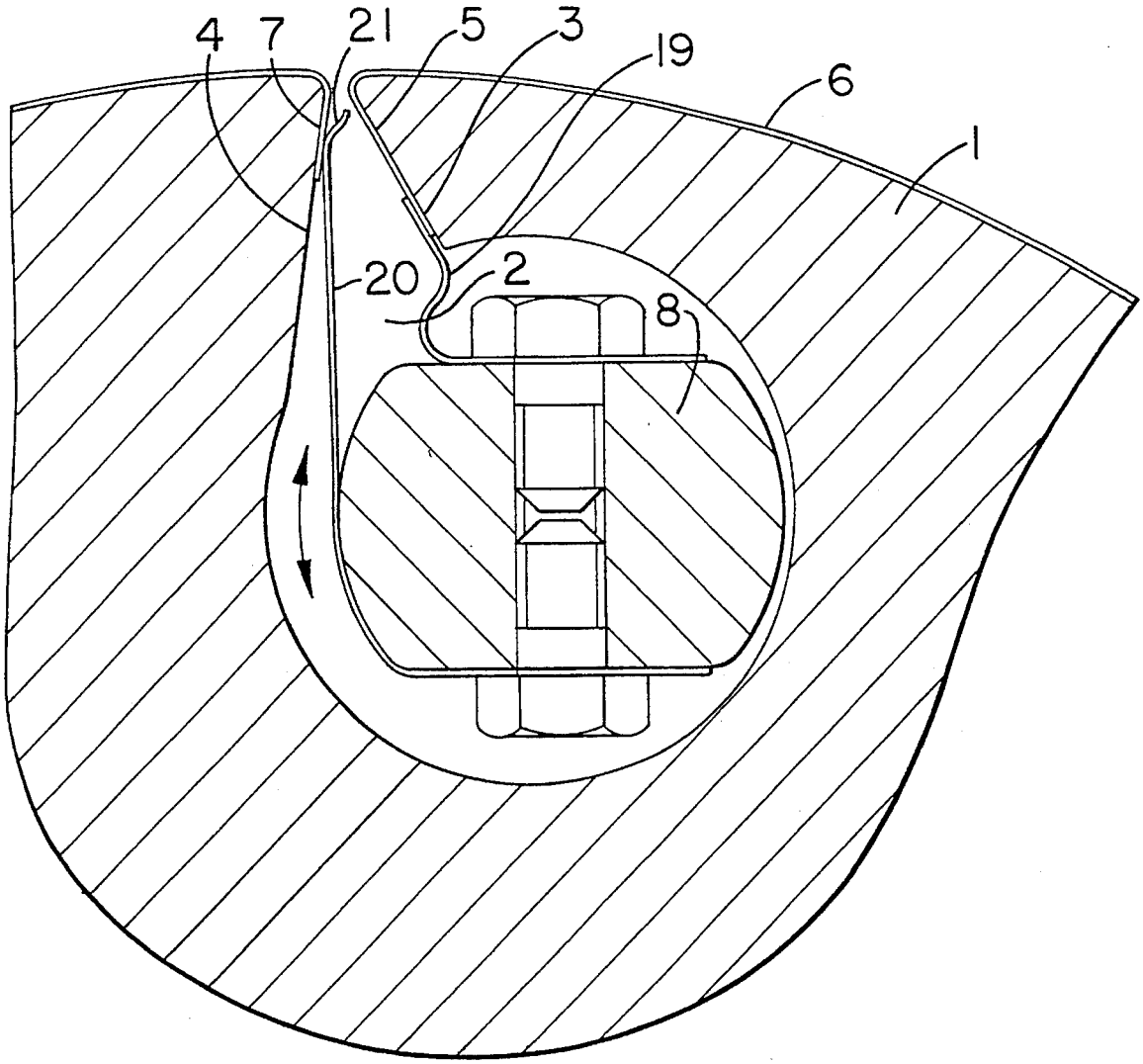
FIG. 1 shows a plate clamping arrangement pursuant to the present invention in cross section.
Figure 2:
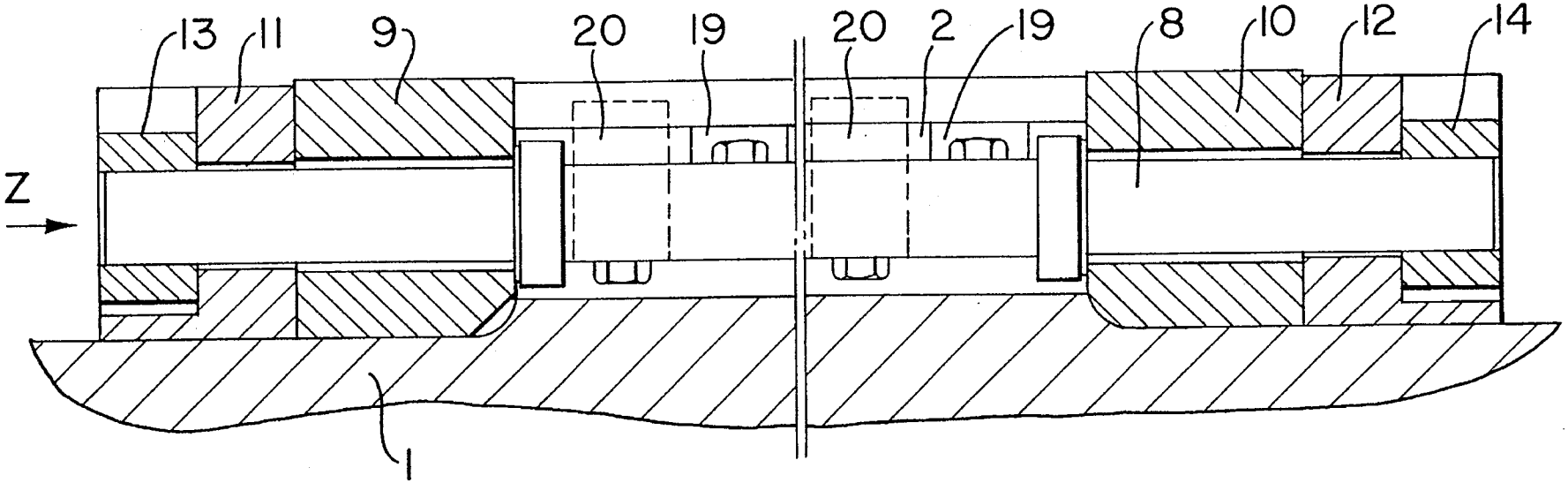
FIG. 2 shows the plate clamping arrangement in longitudinal section.
Figure 3:
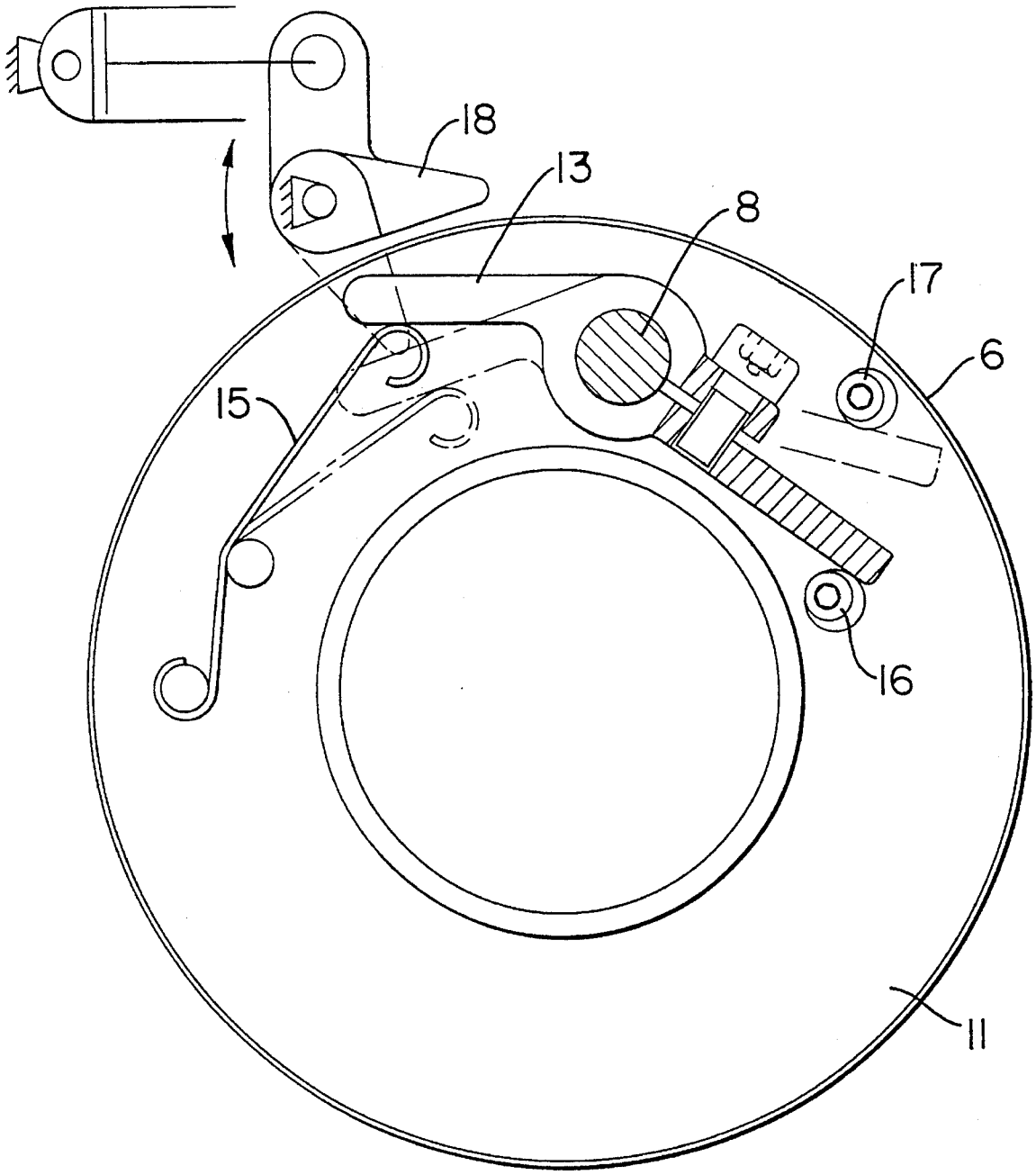
FIG. 3 shows view Z from FIG. 2.
Figure 5:
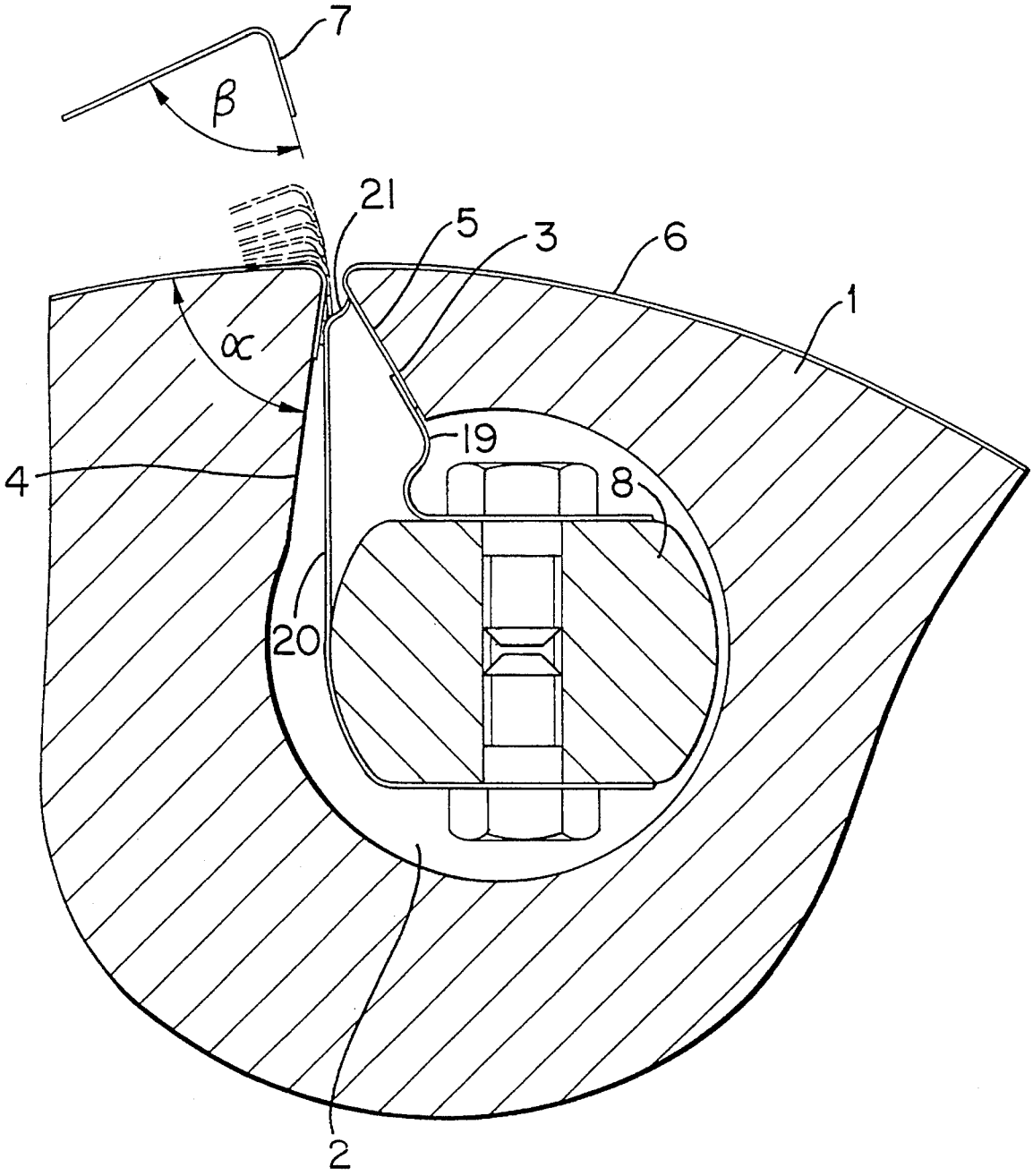
FIG. 5 shows the insertion of the trailing leg of the plate.

The form cylinder 1 shown in FIG. 1 has a cylinder cavity 2 extending in the axial direction and comprising two cavity walls 3, 4. The first cavity wall 3 extends at an acute angle to the outer surface of the cylinder and forms all edge therewith, the forward or leading leg 5 of the printing plate 6 being received at this edge. The second cavity wall 4 encloses an angle $\alpha$ with the outer surface of the cylinder, where $\alpha$ is greater than or equal to 75° and less than or equal to 87° (FIG. 5). The rear or trailing plate leg 7 is placed against the second cavity wall 4. A spindle 8 is arranged in the cylinder cavity 2, guided through cylinder bearers or bearer rings 9, 10, if necessary, and supported in bearings 11, 12 at the end of the cylinder cavity 2 so as to be rotatable (FIG. 2). A lever 13, 14 is secured at either end of the spindle 8. If desired, only one lever may be provided. Each lever 13, 14 is loaded by a spring 15 arranged at the end face of the form cylinder. The lever 13 is constructed as a double-lever having a second lever arm that cooperates with adjustable stops 16, 17 which define the degree of rotation of the spindle 8 (FIG. 3). In the illustrated embodiment, the stops 16, 17 are constructed as eccentric disks which are screwed to the end side of the form cylinder 1. A cam 18 acts on the lever 13 and also on the lever 14, if provided. In FIG. 3 the cam 18 is supported in the printing press frame and is driven by a pneumatic cylinder. However, a work cylinder acting directly on the lever could also be used, for example. A plurality of first and second plate-shaped springs 19, 20 are fastened on the spindle 8 so as to be distributed along the length of the printing plate 6. In the stop position shown in the drawing, the first springs 19 resiliently contact the leading plate leg 5 and the second springs 20 resiliently contact the trailing plate leg 7. The springs 19, 20 are advantageously made of stainless steel in order to protect against corrosion.

Figure 4:
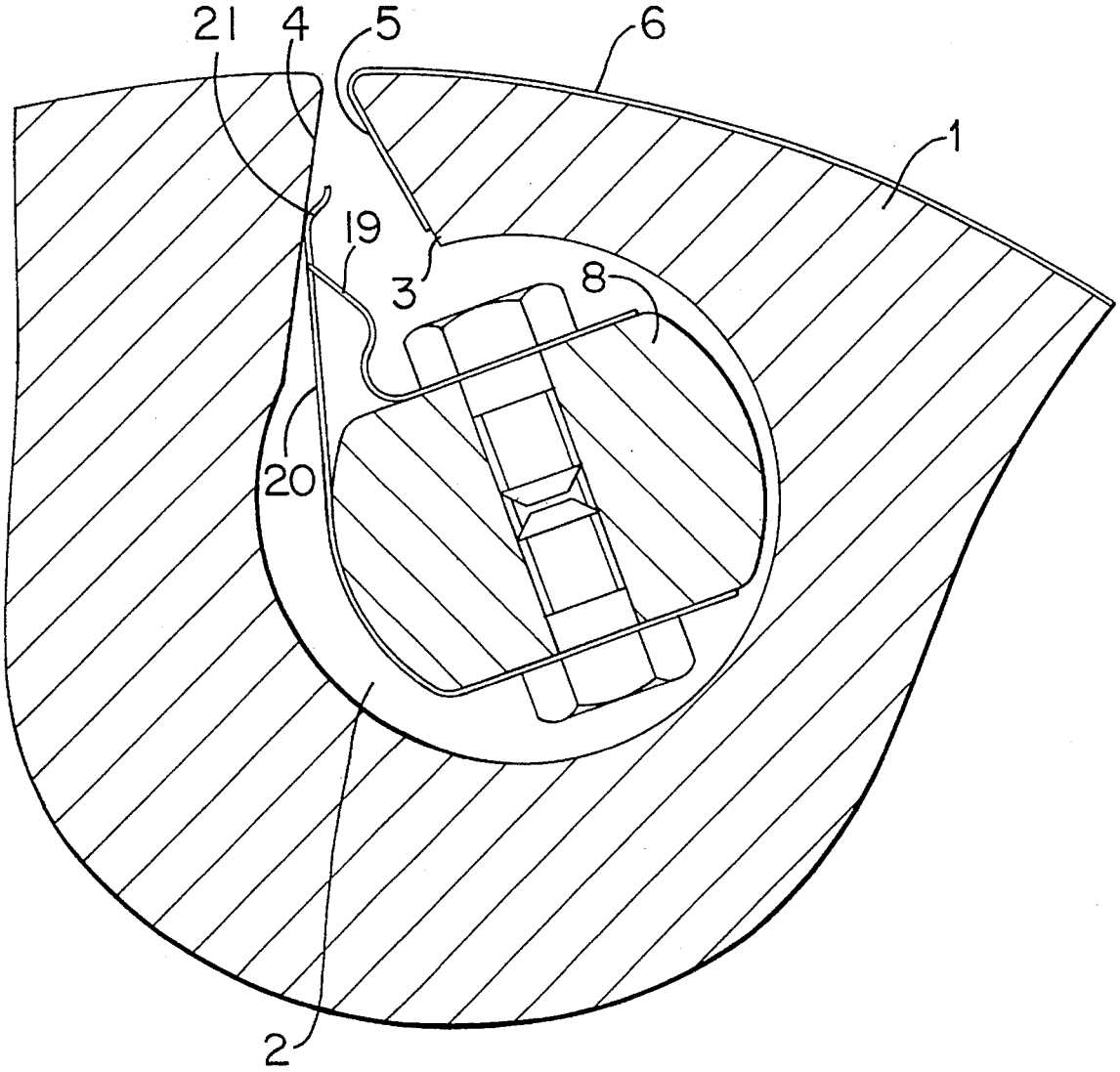
FIG. 4 shows the fastening of the leading leg of the plate.

To install the printing plate 6, the cam 18 is activated and, in so doing, the lever 13 is swiveled against the force of the spring 15 until it encounters the stop 17. This position is shown in a dash-dot line in FIG. 3 and the corresponding position of the spindle 8 is shown in FIG. 4. In this position, the first springs 19 are swiveled away from the cylinder wall 3 and the leading leg 5 of the printing plate 6 can be hooked on at the corresponding edge of the groove. When the cam 18 is subsequently deactivated, the lever 13 is moved back into its initial position by the force of the springs 15 until it encounters stop 16. In so doing, the first springs 19 contact the leading plate leg 5 and secure it by pressing it against the cavity wall 3. When the form cylinder 1 is subsequently rotated in the counterclockwise direction, the printing plate 6 is wound onto the form cylinder 1 and the trailing plate leg 7 is finally pressed into the cylinder cavity 2 between the second springs 20 and the second cavity wall 4. In addition, the transfer cylinder or a roller is advantageously adjusted or advanced toward the form cylinder 1. Further, the second springs 20 have a curved portion 21 to assist insertion of the trailing leg 7. The trailing plate leg 7 is secured by the force of the springs 20 pressing against them.

Figure 6:
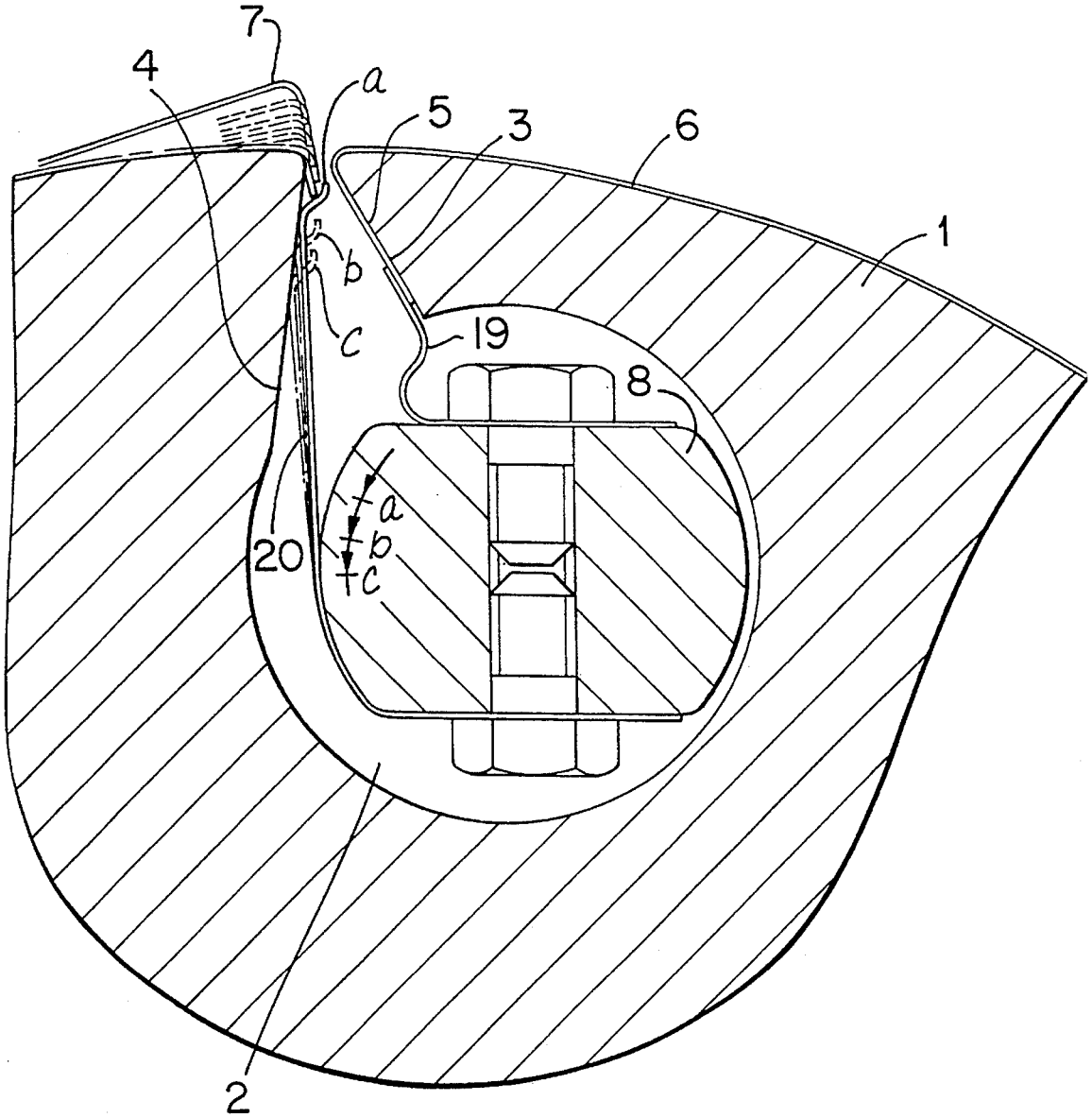
FIG. 6 shows the pushing out of the trailing leg of the plate.

To remove the printing plate 6, the lever 13 is moved into the position shown in dash-dot lines in FIG. 3 by the cam 18. As the spindle 8 swivels, the second springs 20 are pulled downward until reaching the position shown in dash-dot lines in FIG. 6 and release the trailing plate leg 7. The trailing end of the plate now springs up and after the cam 18 is deactivated the lever 13 swivels back along with the spindle 8. The spring 20 sliding along the outside of the cavity wall 4 assists in pushing out the trailing plate leg 7. The printing plate 6 can now be unwound from the form cylinder 1 by rotating the latter in the clockwise direction. The lever 13 is then swiveled against the stop 17 once more and the springs 19 release the leading plate leg 5, whereupon the printing plate 6 can be removed from the form cylinder 1.

The installation and removal of the printing plate described above can be mechanized easily due to the favorable factors for automatic plate changing. However, it is also possible to actuate the spindle manually, wherein the cam need only be replaced by a hand lever and, if necessary, a square neck at the end of the spindle for attaching the hand lever. Furthermore, the up and down sliding movements of the second springs 20 on the second cavity wall 4 accompanying the swiveling movement of the spindle 8 advantageously provide a self-cleaning effect.

By selecting a fold angle $\beta$ between 75° and 87° for the trailing plate leg, the swivel radius for insertion of the trailing plate leg in the cylinder cavity can be kept smaller than would be the case if the plate leg were folded at all angle of 90° so that the clamping groove can have a narrower construction. The range of angles mentioned above also ensures that the trailing plate leg can pass over the appropriate edge of the groove without contacting it and without being permanently deformed. Otherwise, the printing plate would be deformed by the leg pressing against the cavity wall and would be lifted from the outer surface of the cylinder in certain areas. This would also occur in the absence of a fundamental correspondence between the angle $\alpha$ of the groove edge and the fold angle $\beta$ of the printing plate. The printing plate would tend to develop cracks as a result of continuous loading by the transfer cylinder rolling against it.

In the embodiment example, the form cylinder has only one cylinder cavity for clamping a printing plate. It is also intended within the scope of protection of the present patent application that a plurality of cavities for clamping a corresponding number of printing plates could also be arranged so as to be distributed in a uniform manner along the circumference of the form cylinder.

The invention is not limited by the embodiments described above which are presented as examples only but can be modified in various ways within the scope of protection defined by the appended patent claims.

I claim:

1. An arrangement for fastening a flexible printing plate on a form cylinder of a printing press, comprising: a form cylinder having at least one axially directed cavity with a first wall that terminates at an acute angle with an outer surface of the cylinder so as to form an edge on which a leading leg of the printing plate is supportable, and a second wall on which a trailing leg of the printing plate is contactable; a spindle mounted in the cylinder cavity so as to be swivelable about a longitudinal axis; and a plurality of separate first and second plate-like springs distributed along and fastened to the spindle so that the first springs press the leading plate leg against the first wall of the cavity and the second springs press the trailing plate leg against the second wall of the cavity, whereby swiveling of the spindle disengages the springs from the plate legs and the second springs being arranged and adapted to be pullable into the cylinder cavity by swiveling of the spindle.

2. An arrangement according to claim 1, and further comprising a spring-loaded lever mounted on the spindle, and stop means for limiting rotation of the spindle by contacting the lever.

3. All arrangement according to claim 2, and further comprising cam means for engaging the lever to rotate the spindle.

4. An arrangement according to claim 2, and further comprising piston-cylinder means for engaging the lever to rotate the spindle.

5. An arrangement according to claim 1, wherein the second wall of the cavity forms an angle $\alpha$, where $75° \leqq \alpha \leqq 87°$, with the outer surface of the cylinder.

6. An arrangement according to claim 5, wherein the trailing leg of the printing plate is folded at an acute angle $\beta$, where $\beta=\alpha$.

7. An arrangement according to claim 1, wherein the second springs have a free end that is curved so as to facilitate insertion of the trailing leg of the plate.

8. An arrangement according to claim 1, wherein the second springs and the first springs are mounted to the spindle so that the second springs are disengagable from the trailing leg before the first springs are disengagable from the leading leg when the spindle is swiveled.

* * * * *